US010697182B2

(12) United States Patent
Huber

(10) Patent No.: US 10,697,182 B2
(45) Date of Patent: Jun. 30, 2020

(54) RAFTER VENT SYSTEM FOR HIP ROOFS AND VALLEYS

(71) Applicant: Barry R. Huber, Lake City, FL (US)

(72) Inventor: Barry R. Huber, Lake City, FL (US)

( * ) Notice: Subject to any disclaimer, the term of this patent is extended or adjusted under 35 U.S.C. 154(b) by 0 days.

(21) Appl. No.: 16/245,043

(22) Filed: Jan. 10, 2019

(65) Prior Publication Data

US 2019/0211564 A1 Jul. 11, 2019

Related U.S. Application Data

(60) Provisional application No. 62/615,673, filed on Jan. 10, 2018.

(51) Int. Cl.
*E04D 13/17* (2006.01)
*F24F 7/02* (2006.01)

(52) U.S. Cl.
CPC ..... *E04D 13/172* (2013.01); *E04D 13/174* (2013.01); *E04D 13/178* (2013.01); *F24F 7/02* (2013.01)

(58) Field of Classification Search
CPC ..... E04D 13/172; E04D 13/174; E04D 13/17; F24F 7/02
See application file for complete search history.

(56) References Cited

U.S. PATENT DOCUMENTS

| | | | | |
|---|---|---|---|---|
| 3,797,180 | A | 3/1974 | Grange | |
| 4,237,672 | A | 12/1980 | Peterson | |
| 4,406,095 | A | 9/1983 | Slavik | |
| 5,596,847 | A | 1/1997 | Stephenson | |
| 6,357,185 | B1 | 3/2002 | Obermeyer et al. | |
| 7,765,750 | B2 | 8/2010 | Duncan | |
| 8,562,400 | B2 | 10/2013 | Klement | |
| 8,763,330 | B2 | 7/2014 | Pollack | |
| 2006/0010805 | A1* | 1/2006 | Hockman | E04B 1/7654 52/404.1 |
| 2008/0318516 | A1* | 12/2008 | Rotter | E04D 13/174 454/365 |

* cited by examiner

*Primary Examiner* — Patrick J Maestri
(74) *Attorney, Agent, or Firm* — Thomas C. Saitta

(57) ABSTRACT

A rafter vent system suitable for valley roof or hip roof construction, the system having at least one rafter bypass channel member in fluid communication with rafter vent members positioned between adjacent hip or valley rafters, the rafter bypass channel member providing a bypass channel for passage of ventilating air along a hip or valley rafter, such that a passageway is created extending between eave vents and ridge vents.

20 Claims, 6 Drawing Sheets

FIG. 6
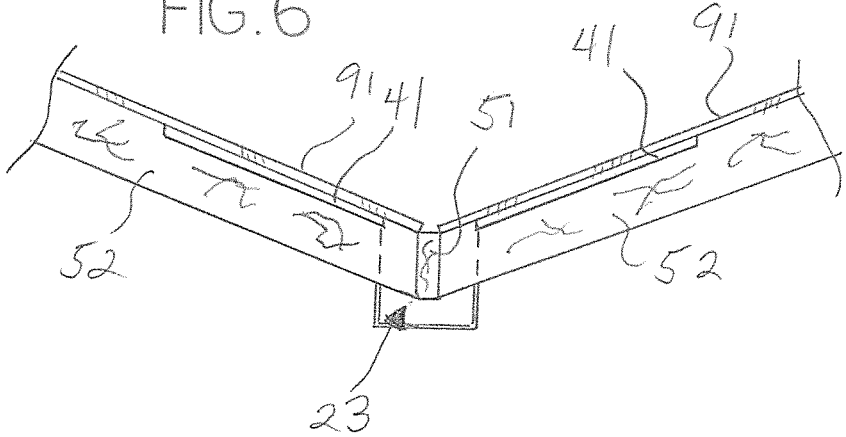
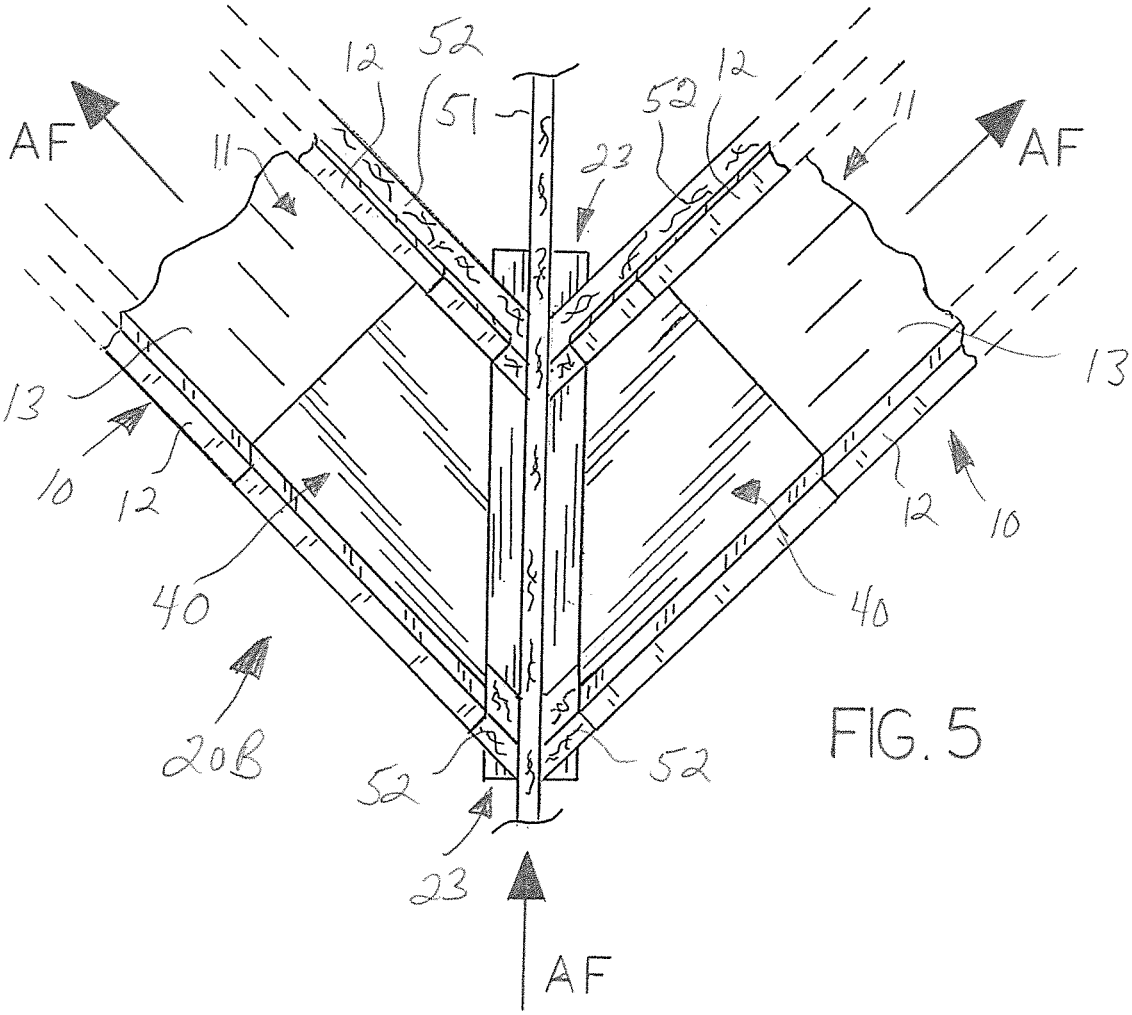
FIG. 5

RAFTER VENT SYSTEM FOR HIP ROOFS AND VALLEYS

BACKGROUND OF THE INVENTION

This application relates generally to the field of roof and attic ventilation systems, and more particularly to devices or systems commonly referred to as rafter vents, baffle vents, attic insulation vents, venting channels or under-roof-deck vents (to be referred to hereinafter collectively as rafter vents and rafter vent systems). In general, rafter vent members and rafter vent systems are utilized to provide ventilating air flow beneath the deck members of roof systems, and are of particular use when under-deck or rafter attic insulation products are utilized to reduce heat transfer from the roof into the attic, such as for example fiber mats or batts secured by mechanical fasteners or foaming insulation sprayed-in-place on the underside of the deck members between the attic rafters, since the presence of this insulation blocks air flow along the underside of the deck members. The positioning of rafter vents between the roof deck members and the insulating material, if present, increases the air flow beneath the roof decking lowers the temperature of the roof, thereby decreasing the damaging effects of high temperature on the roof membrane, shingles, etc.

It is known to provide rafter vent members that are positioned under the deck members and between the rafters prior to installation of the attic insulation, the rafter vent members being structured to form one or more elongated channels or chutes that enable air to flow upwardly along the underside of the roof from the soffit area eave vents to the ridge or roof vents located at or near the ridge board. Examples of such rafter vent systems are shown in U.S. Pat. Nos. 5,596,847, 8,562,400, 4,406,095, and 4,237,672. The rafter vent members are typically formed from thin plastic sheets and may be positioned atop the rafters prior to installation of the roof decking. Alternatively, the rafter vent members may be placed between the rafters after installation of the decking on the rafters, the rafter vent members being secured with mechanical fasteners, adhesive, or a friction-fit structural design. With the rafter vent members in place, the rafter vent members maintain under-deck ventilating channels after the internal attic insulation has been applied to the underside of the rafter vent members. As the temperature of the roof increases because of high ambient temperatures and exposure to sunlight, air occupying the passage between the rafter vent members and the underside of the roof deck members is warmed by heat induction through the roof, causing the warm air to rise and exit through roof vent or ridge vent outlets while simultaneously drawing in cooler air through the eave vents.

These systems have proven to work satisfactorily when used on the portions of the roof where the rafters, typically referred to as common rafters, fully extend from the eaves to the roof ridge, such that heated rising air may pass through roof or ridge vents and cooler air may be drawn in through the eave vents. However, a problem arises in that rafter vent members will not properly function in roofs having jack rafters, defined as rafters that do not extend fully between the eaves and the roof ridge, such as found in hip roofs or valley roofs. In hip roofs the jack rafters extend from the eaves up to the angled hip rafters rather than to the horizontal roof ridge boards, and there are no upper outlet vents for release of heated ventilated air into the atmosphere. Thus, air in the passages between adjacent jack rafters remains trapped. Similarly, in valley roofs the jack rafters extend from the horizontal roof ridge board to the angled valley rafters rather than to the eaves, so there are no lower inlet vents to receive cooler venting air and air in the passages remains trapped.

It is an object of this invention to provide a rafter vent system that is suitable for use with jack rafters as found in hip roofs or valley roofs, whereby a combination of hip rafter bypass channel members form an upwardly extending bypass channel or chute along the underside of the hip rafter that receives heated air from the upper ends of the rafter vent members positioned between the hip jack rafters and delivers it upwardly to the area of the ridge board and ridge vents, or whereby a combination of valley rafter bypass channel members form an upwardly extending bypass channel along the underside of the valley rafters that receives cooler venting air from the eave vents and delivers it into the lower ends of the rafter vent members positioned between the valley jack rafters. It is a further object to create in hip roofs and valley roofs a complete ventilating pathway beneath the deck members of a roof which extends from the eave vents to the ridge vents.

SUMMARY OF THE INVENTION

In various embodiments, the invention is shown and described as a rafter vent system suitable for roofs having jack rafters—a rafter that does not completely extend from the eaves to the horizontal ridge board of a roof, instead connecting with an angled hip rafter or valley rafter. The rafter vent system in general comprises rafter vent members positioned between adjacent jack rafters in combination and in communication with one or more upwardly angled hip or valley rafter bypass channel members positioned under a hip rafter or a valley rafter, the rafter bypass channel members defining an upwardly extending bypass channel or passage for ventilating air movement beneath the roof decking and between the rafters that is not blocked by the hip rafter or valley rafter. The hip/valley rafter bypass channel, preferably comprising a combination of multiple hip/valley rafter bypass channel members, is an upwardly extending passage for ventilating air movement beneath the hip/valley rafter. A hip rafter bypass channel is in fluid communication with the upper ends of hip jack rafter vent members and the roof or ridge vent openings for a hip roof, whereby air is drawn into the eave vents, passes through the hip jack rafter vent members into the hip rafter bypass channel to be delivered upward to the ridge board and roof or ridge vents. A valley rafter bypass channel is in fluid communication with the eave vent openings and the lower ends of valley jack rafter vent members, whereby air is drawn through the eave vents into the valley rafter bypass channel, passing into the valley rafter vent members and is delivered to the ridge board and roof vents. In this manner a complete ventilating air passageway is defined from the eave or soffit vent openings, to be referred to herein collectively as eave vents, to the roof or ridge vent openings on or near the horizontal ridge board, to be referred to herein collectively as ridge vents, that functions in similar manner to standard rafter vent systems for common rafters which extend from the eaves to the ridge board.

In a hip roof construction, the rafter vent members are positioned between the jack rafters of the hip roof and define upwardly extending passages extending from the area of the eave vents toward the hip rafter, where they communicate with lateral openings on the hip rafter bypass member such that air may flow from the hip jack rafter vent members into the hip rafter bypass channel. The hip rafter bypass channel members which define the hip rafter bypass channel are mounted to the jack rafters, with the hip rafter bypass channel member creating a bypass channel or passageway beneath a portion of the hip rafter. The hip rafter bypass channel member extends beyond the sides of the hip rafter and is mounted to a first set of adjacent jack rafters on the first side of the hip rafter and to a second set of adjacent jack rafters on the second side of the hip rafter, and correspondingly connects to a first rafter vent member mounted between the first set of jack rafters and a second rafter vent member mounted between the second set of jack rafters. Each hip rafter bypass channel member is structured to provide in combination with other hip rafter bypass channel members an upwardly extending ventilating or bypass channel beneath the hip rafter. The hip rafter bypass channel members may be formed as unitary members or may comprise a first side member and a second side member which overlap or interconnect to define the hip rafter bypass channel.

With the hip rafter bypass channel members and their corresponding rafter vent members positioned between each set of adjacent jack rafters along the complete length of the hip rafter, the hip rafter bypass channel members combine to define an elongated hip rafter bypass channel extending the length of the hip ridge. In this manner, ventilating air is able to pass from the eave vents into the lower opening of the hip jack rafter vent member, where it flows upwardly through upper opening of the hip jack rafter vent member and into the elongated hip rafter bypass channel members, to then pass through the bypass channel to be exhausted into the atmosphere through ridge vents.

In similar manner, embodiments of the invention are rafter vent systems suitable for use with valley roofs. The valley rafter bypass channel members form an upwardly extending valley rafter bypass channel extending from the area of the eave vents to the lower ends of the valley jack rafter vent members positioned between the valley jack rafters, such that air flowing upwardly through the valley rafter bypass channel is directed into the valley jack rafter vent members, to then be exhausted from the ridge vents.

In alternative format, the invention is a rafter ventilating system comprising a rafter bypass channel member in combination with rafter vent members sized and configured to fit between adjacent hip or valley jack rafters in a hip roof or a valley roof; said rafter bypass channel member comprising a pair of opposing lateral wings extending from a bypass channel, said rafter bypass channel member sized and configured such that said lateral wings are in fluid communication with said rafter vent members and with said bypass channel, and such that said rafter bypass channel member is mountable in a hip roof or a valley roof such that said bypass channel is disposed about a hip rafter or a valley rafter.

BRIEF DESCRIPTION OF THE DRAWINGS

FIG. 5 illustrates the valley rafter channel bypass member of FIG. 4 as mounted onto a valley roof and in combination with valley jack rafter vent members.

FIG. 6 is an end view of the valley rafter channel bypass member of FIG. 4 as mounted onto a valley roof.

DETAILED DESCRIPTION OF THE INVENTION

Figure 1:
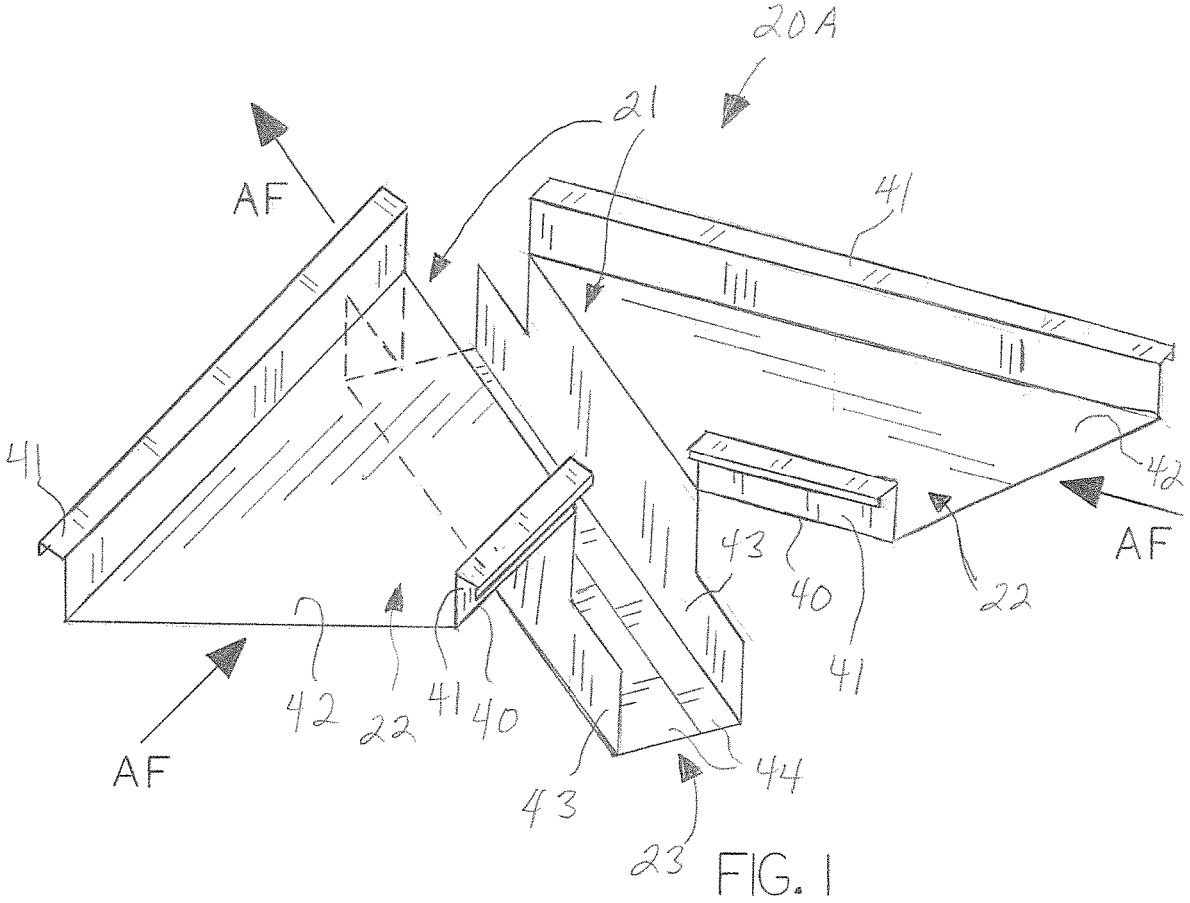
FIG. 1 is a perspective view of an embodiment of a hip rafter bypass channel member.

In general, as shown in the illustrations, the invention is a rafter vent system that addresses ventilation flow problems in hip roofs 30 and valley roofs 50. A hip roof 30 comprises in simple form an angled hip rafter 31 that extends from a horizontal ridge board 90 downwardly to the eaves, typically formed by the combination of a facia board and a soffit board, with eave vents disposed in the soffit board. Hip jack rafters 32 extend from the eaves to the hip rafter 31. A valley roof 50 comprises in simple form an angled valley rafter 51 that extends from the ridge board 90 downwardly to the eaves. Valley jack rafters 52 extend from the ridge board 90 to the jack rafter 51. Common rafters 92 extend from the eaves to the ridge board 90. Ridge vents are positioned at or adjacent the ridge board 90 such that heated air beneath the roof decking 91 will rise to the ridge vents and be dispersed into the ambient, while cooler air is drawn in through the eave vents. Because hip jack rafters 32 do extend up to the ridge vents, instead being blocked by the hip rafter 31, and valley jack rafters 52 do not extend down to the eave vents, instead being blocked by the valley rafter 51, heated air is blocked by the hip rafters 31 from passing up to the ridge vents and outside cool air is blocked by the valley rafters 51 from passing into the area between the valley jack rafters 52.

The hip/valley rafter vent system described herein comprises rafter vent members 10 which are known in the art. The rafter vent members 10 are utilized with common rafters 92 and typically are thin plastic members having a floor member 13 bounded by a pair of mounting members 13 which enable the rafter vent member 10 to be affixed between adjacent rafters underneath roof decking 91, thereby creating a defined ventilating passage 11 below the decking 91 that is not blocked by the application of insulation beneath the rafter vent members 10. The rafter vent members 10 may be mechanically fastened or adhesively bonded to the top or sides of the rafters 20, or they may be sized for retention by friction. In a preferred embodiment, the floor members 13 of the rafter vent members 10 are provided with pleated or angled segments which allow the width of a rafter vent member 10 to be increased or decreased to account for variations in the distance between rafters without significantly altering the depth of the rafter vent member 10. The rafter vent members 10 may also be configured to extend across more than two rafters.

One or more rafter bypass channel members 20 are utilized in combination with rafter vent members 10 to address the problems described in ventilating hip roofs 30 and valley roofs 50. The rafter bypass channel members 20 have two main embodiments-embodiment 20A for hip roofs 30 and embodiment 20B for valley roofs 50. As will be described in more detail below, the rafter bypass channel member 20A comprises lateral wings 41 that angle downward to accommodate the downward slope of the hip jack rafters 32, while the rafter bypass channel member 20B comprises lateral wings 41 that angle upward to accommodate the upward slope of the valley jack rafters 52.

Figure 7:
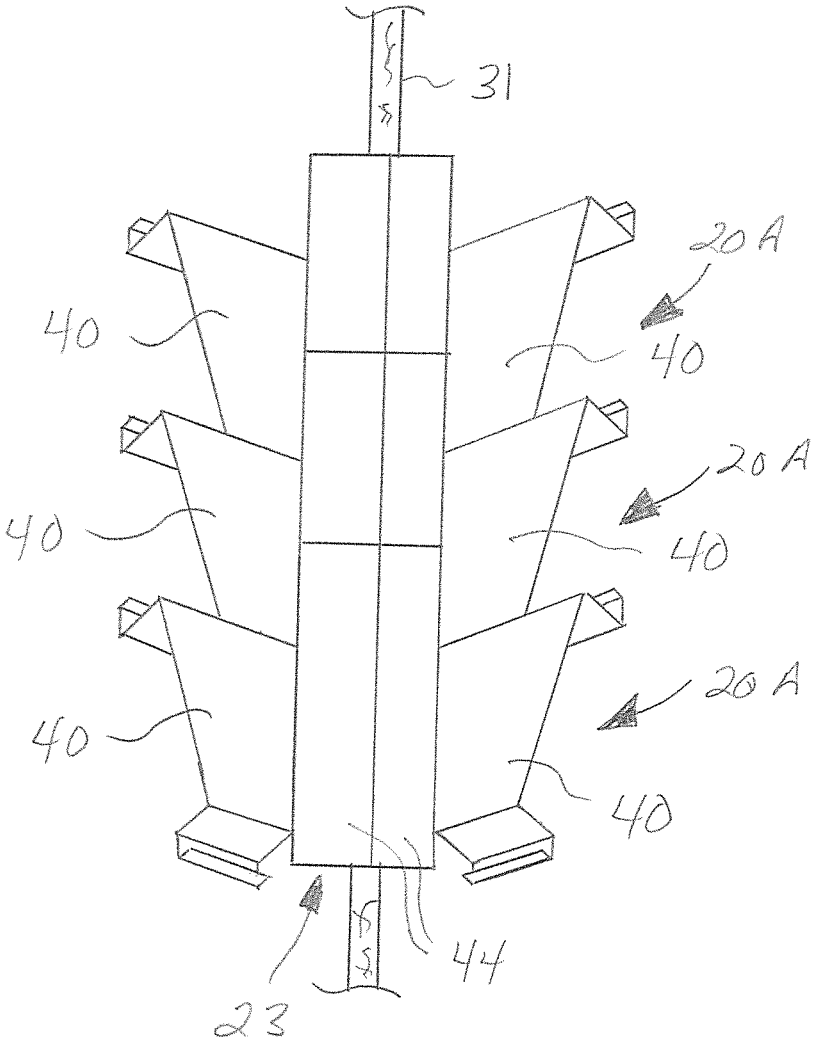
FIG. 7 is an underside view showing an assembly of hip rafter bypass channel members positioned along a hip rafter to form a bypass channel.
Figure 8:
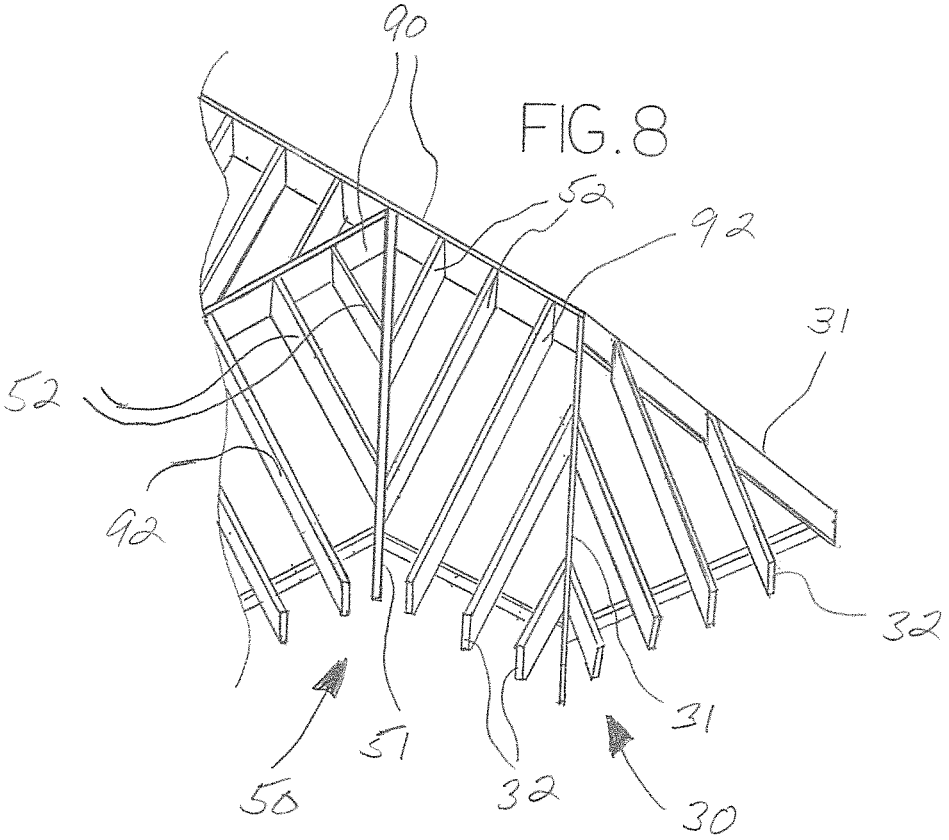
FIG. 8 is an illustration of an example of a hip roof and a valley roof, as shown with common rafters, hip jack rafters and valley jack rafters.

In some circumstances a single rafter bypass channel member 20 may be sufficient to address the ventilation problem, but in many situations multiple rafter bypass channel members 20 will be combined in a linear manner along the hip rafter 31 or valley rafter 51 to accommodate a large number of jack rafters 32 or 52. An example of this is illustrated in FIG. 7, which shows a combination of three hip rafter bypass channel members 20A positioned on a hip rafter 31. The rafter bypass channel members 20 may be formed as a unitary member, as shown in FIGS. 4-6, or may be formed as two lateral components that are overlapped or otherwise connected, as shown in FIGS. 1-3 and 7. The rafter bypass channel members 20 are preferably formed of thin, slightly flexible sheet material such as plastic or aluminum.

A rafter bypass channel member 20A for hip roofs 30 is illustrated in FIGS. 1-3 and 7. The rafter bypass channel members 20A comprises a pair of opposed lateral wings 40 that are sixed to fit between adjacent hip jack rafters 31. Wing mounting members 41 are provided for affixation to the hip jack rafters 31, and as shown in this embodiment each wing mounting member 41 may comprise a generally vertical or angled wall, an overlay portion and lip member. The lateral wings 40 further comprise a wing floor member 42 and the wing mounting members 41 are designed such that the wing floor member 42 occupies a position a short distance below the roof decking 91 when installed, thereby creating a ventilating passage 22. The configuration of the lateral wings 40 and the configuration of the rafter vent members 10 are chosen to mate or correspond, preferably in abutting or overlapping manner, such that air may flow from the raft vent member ventilating passage 11 into the lateral wing ventilating passage 22.

The lateral wings 40 extend outwardly from an elongated bypass channel 23 formed by channel walls 43 and channel floor 44. The lateral wings 40 for the rafter bypass member 20A extend downwardly relative to the channel bypass 23 to correspond to the downward angle at which the hip jack rafters 32 extend from the hip rafter 31, and the lateral wings 40 also extend from the channel bypass 23 at 45 degree angles to correspond to the angle of the junction between the hip jack rafters 32 and the hip rafter 31. A lateral opening 21 is provided at the junction of each lateral wing 40 with the channel bypass wall 43 such that ventilating air may pass from the lateral wing ventilating passage 21 into the bypass channel 23.

Figure 3:
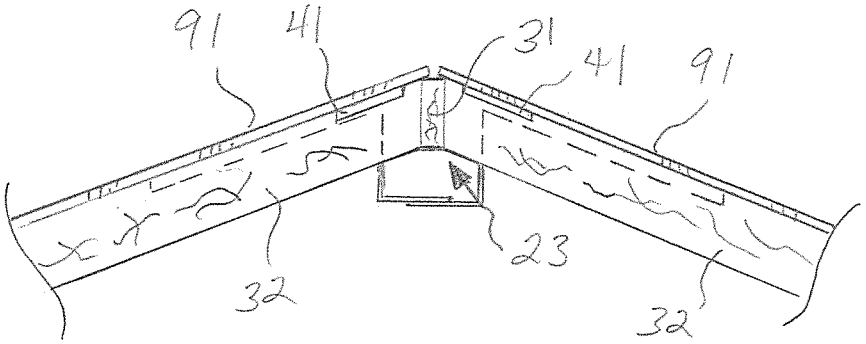
FIG. 3 is an end view of the hip rafter channel bypass member of FIG. 1 as mounted onto a hip roof.
Figure 4:
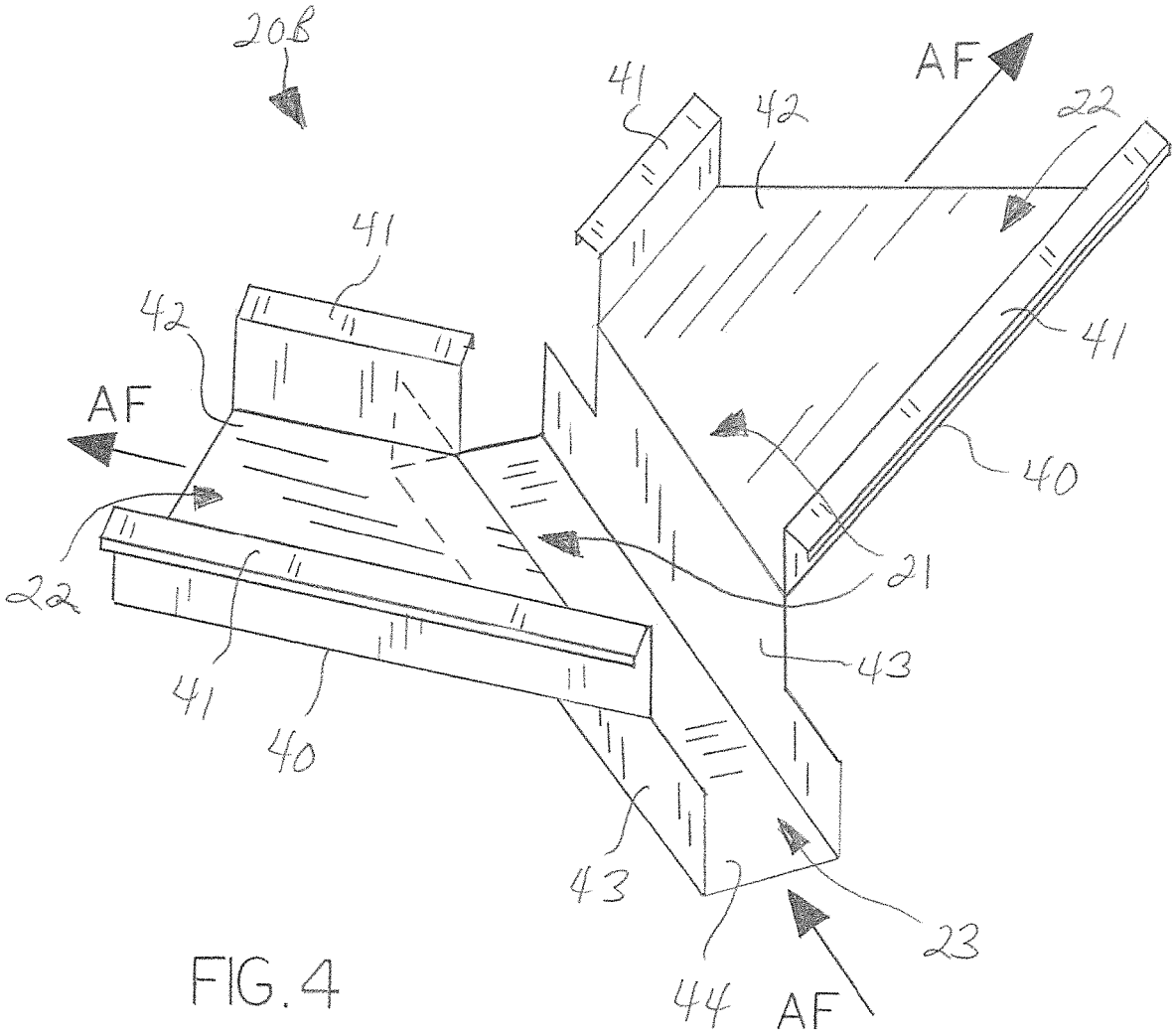
FIG. 4 is a perspective view of an embodiment of a valley rafter bypass channel member.

The overall depth of the rafter bypass channel member 20A is chosen such that the channel floor 44 is separated from the bottom of hip rafter 31 when installed, and likewise the channel walls 43 are laterally separated from the sides of the hip rafter 31, thereby creating gaps between the hip rafter 31 and the rafter bypass channel members 20A such that a relatively large volume of ventilating air may pass through the bypass channel 23, as seen best in FIG. 3. Thus, the width and depth of the channel member 23 is greater than the width and depth of the hip rafter 31. The bypass channel 23 is open on both ends.

Figure 2:
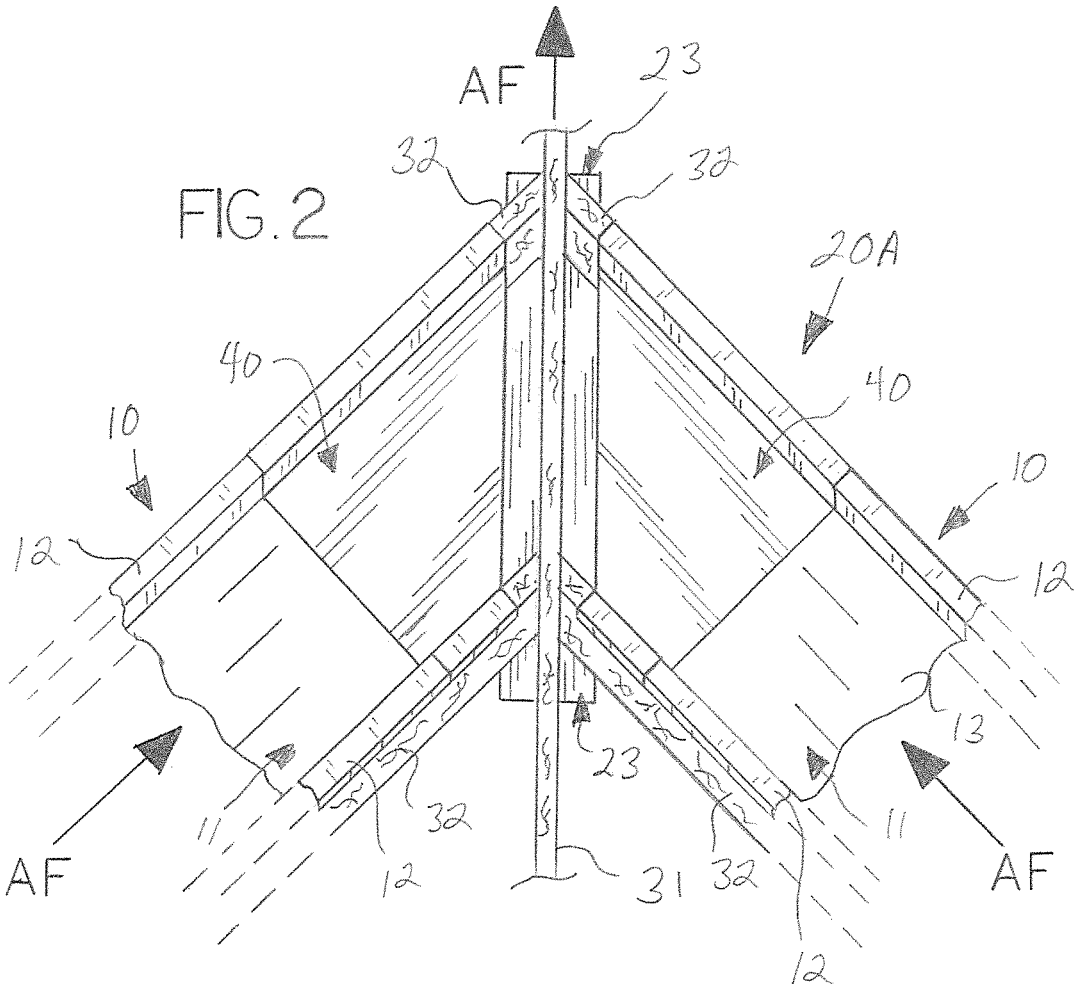
FIG. 2 illustrates the hip rafter channel bypass member of FIG. 1 as mounted onto a hip roof and in combination with hip jack rafter vent members.

To provide ventilation beneath the decking 91 and between hip jack rafters 31, rafter vent members 10 are installed to extend from the eave vents to a short distance from the hip rafter 31, and one or more hip rafter bypass channel members 20B are mounted to fluidly communicate with the rafter vent members 10. As seen in FIGS. 2, 3 and 7, the longitudinal axis of the channel bypass 23 is parallel to the longitudinal axis of the hip rafter 31, thereby creating an upwardly extending passageway such that cooler ambient air may be drawn into the rafter vent members 10 through eave vents, where it is pulled through the rafter vent ventilating passages 11 and the rafter bypass ventilating passages 23 and into the bypass channel 23. The bypass channel conducts the air upwardly along the hip rafter 31 and is dispelled at or near the roof board 90 and ridge vents, such that the areas adjacent to hip jack rafters 32 are no longer dead zones restricted by the hip rafter 31.

An embodiment of the rafter bypass channel member 20 suitable for use with valley roofs 50 is illustrated in FIGS. 4-6. The valley rafter bypass channel member 20B differs from the hip rafter bypass channel 20A in the angle of the lateral wings 40 relative to the bypass channel 23. In a valley roof 50, the valley jack rafters 32 angle upwardly from the valley rafter 51, and therefore the lateral wings 40 in the rafter bypass channel member 20B angle upwardly from the bypass channel 23.

The rafter bypass channel members 20B comprises a pair of opposed lateral wings 40 that are sixed to fit between adjacent valley jack rafters 51. Wing mounting members 41 are provided for affixation to the valley jack rafters 51, and as shown in this embodiment each wing mounting member 41 may comprise a generally vertical or angled wall, an overlay portion and lip member. The lateral wings 40 further comprise a wing floor member 42 and the wing mounting members 41 are designed such that the wing floor member 42 occupies a position a short distance below the roof decking 91 when installed, thereby creating a ventilating passage 22. The configuration of the lateral wings 40 and the configuration of the rafter vent members 10 are chosen to mate or correspond, preferably in abutting or overlapping manner, such that air may flow from the raft vent member ventilating passage 11 into the lateral wing ventilating passage 22.

The lateral wings 40 extend outwardly from an elongated bypass channel 23 formed by channel walls 43 and channel floor 44. The lateral wings 40 for the rafter bypass member 20B extend upwardly relative to the channel bypass 23 to correspond to the upward angle at which the valley jack rafters 52 extend from the valley rafter 51, and the lateral wings 40 also extend from the channel bypass 23 at 45 degree angles to correspond to the angle of the junction between the valley jack rafters 52 and the valley rafter 51. A lateral opening 21 is provided at the junction of each lateral wing 40 with the channel bypass wall 43 such that ventilating air may pass from the lateral wing ventilating passage 21 into the bypass channel 23.

The overall depth of the rafter bypass channel member 20A is chosen such that the channel floor 44 is separated from the bottom of valley rafter 51 when installed, and likewise the channel walls 43 are laterally separated from the sides of the valley rafter 51, thereby creating gaps between the valley rafter 51 and the rafter bypass channel members 20B such that a relatively large volume of ventilating air may pass through the bypass channel 23, as seen best in FIG. 6. Thus, the width and depth of the channel member 23 is greater than the width and depth of the valley rafter 51. The bypass channel 23 is open on both ends.

To provide ventilation beneath the decking 90 and between valley jack rafters 51, rafter vent members 10 are installed to extend from the area of the ridge board 90 and ridge vents to a short distance from the valley rafter 51, and one or more valley rafter bypass channel members 20B are mounted to fluidly communicate with the rafter vent members 10. As seen in FIGS. 5 and 6, the longitudinal axis of the channel bypass 23 is parallel to the longitudinal axis of the valley rafter 51, thereby creating an downwardly extending passageway such that cooler ambient air may be drawn from the eave vents into the bypass channel 23, from where it is delivered through the lateral wings 40 into the rafter vent members 10 to be dispelled at or near the roof board 90 and ridge vents, such that the areas adjacent to valley jack rafters 52 are no longer dead zones restricted by the valley rafter 51.

It is understood that substitutions and equivalents for certain elements and structures disclosed may be obvious to those of ordinary skill in the art, and therefore the true scope and definition of the invention is to be as set forth in the following claims.

The invention claimed is:

1. A rafter ventilating system comprising a rafter bypass channel member in combination with rafter vent members sized and configured to fit between adjacent hip or valley jack rafters in a hip roof or a valley roof;

said rafter bypass channel member comprising a bypass channel and a pair of opposing lateral wings extending from said bypass channel, each of said pair of opposing lateral wings defining a ventilating passage in fluid communication with said bypass channel and with one of said rafter vent members;

said rafter bypass channel member sized and configured such that said rafter bypass channel member is mountable in a hip roof or a valley roof such that said bypass channel is configured to be disposed beneath and on both sides of a hip rafter or a valley rafter.

2. The system of claim 1, wherein each of said pair of opposing lateral wings comprises wing mounting members sized and configured to sit atop said hip or valley jack rafters.

3. The system of claim 2, wherein each of said wing mounting members comprises an overlay portion and a lip member.

4. The system of claim 1, wherein each of said pair of opposing lateral wings extends from said bypass channel at an angle of 45 degrees.

5. The system of claim 4, wherein said pair of opposing lateral wings extends either upward or downward relative to said bypass channel.

6. The system of claim 2, wherein each of said pair of opposing lateral wings extends from said bypass channel at an angle of 45 degrees.

7. The system of claim 6, wherein said pair of opposing lateral wings extends either upward or downward relative to said bypass channel.

8. The system of claim 1, wherein each of said pair of opposing lateral wings is in fluid communication with said bypass channel through a lateral opening in said rafter bypass channel member.

9. The system of claim 2, wherein each of said pair of opposing lateral wings is in fluid communication with said bypass channel through a lateral opening in said rafter bypass channel member.

10. The system of claim 4, wherein each of said pair of opposing lateral wings is in fluid communication with said bypass channel through a lateral opening in said rafter bypass channel member.

11. The system of claim 5, wherein each of said pair of opposing lateral wings is in fluid communication with said bypass channel through a lateral opening in said rafter bypass channel member.

12. The system of claim 1, wherein said rafter bypass channel member comprises a pair of channel walls and a channel floor defining said bypass channel, and wherein said pair of channel walls and said channel floor are spaced apart from said hip or valley jack rafters.

13. The system of claim 2, wherein said rafter bypass channel member comprises a pair of channel walls and a channel floor defining said bypass channel, and wherein said pair of channel walls and said channel floor are spaced apart from said hip or valley jack rafters.

14. The system of claim 4, wherein said rafter bypass channel member comprises a pair of channel walls and a channel floor defining said bypass channel, and wherein said pair of channel walls and said channel floor are spaced apart from said hip or valley jack rafters.

15. The system of claim 5, wherein said rafter bypass channel member comprises a pair of channel walls and a channel floor defining said bypass channel, and wherein said pair of channel walls and said channel floor are spaced apart from said hip or valley jack rafters.

16. A rafter ventilating system comprising at least one rafter bypass channel member in combination with rafter vent members sized and configured to fit between adjacent hip or valley jack rafters in a hip roof or a valley roof;

said rafter bypass channel member comprising a pair of channel walls and a channel floor defining a bypass channel, and further comprising a pair of opposing lateral wings each extending from a lateral opening in one of said pair of channel walls in an upward or downward direction relative to said bypass channel, each of said pair of opposing lateral wings defining a ventilating passage in fluid communication with said bypass channel and with one of said rafter vent members, said rafter bypass channel member sized and configured such that said rafter bypass channel member is mountable in a hip roof or a valley roof such that said bypass channel is configured to be disposed beneath, on both sides and separated from a hip rafter or a valley rafter.

17. The system of claim 16, wherein each of said pair of opposing lateral wings comprises wing mounting members sized and configured to sit atop said hip or valley jack rafters.

18. The system of claim 17, wherein each of said wing mounting members comprises an overlay portion and a lip member.

19. The system of claim 16, wherein each of said pair of opposing lateral wings extends from said bypass channel at an angle of 45 degrees.

20. The system of claim 17, wherein each of said pair of opposing lateral wings extends from said bypass channel at an angle of 45 degrees.

* * * * *